United States Patent [19]

Hamano et al.

[11] Patent Number: 4,558,992

[45] Date of Patent: Dec. 17, 1985

[54] PUMP DEVICE

[75] Inventors: Isao Hamano; Akira Morishita; Yoshifumi Akae, all of Himeji; Youji Nishimura, Hyogo; Toshinori Tanaka; Kiyoshi Yabunaka, both of Himeji, all of Japan

[73] Assignee: Mitsubishi Denki Kabushiki Kaisha, Tokyo, Japan

[21] Appl. No.: 728,166

[22] Filed: May 1, 1985

Related U.S. Application Data

[63] Continuation of Ser. No. 548,134, Nov. 2, 1983, abandoned.

[30] Foreign Application Priority Data

Nov. 6, 1982 [JP] Japan ..... 57-168914

[51] Int. Cl.[4] ..... F04B 35/04

[52] U.S. Cl. ..... 417/250; 417/350

[58] Field of Search ..... 417/250, 350, 244, 251

[56] References Cited

U.S. PATENT DOCUMENTS

| | | | |
|---|---|---|---|
| 2,530,682 | 11/1950 | Coldsnow | 417/251 |
| 2,814,254 | 11/1957 | Litzenberg | 417/350 |
| 2,891,717 | 6/1959 | Huitson | 417/250 |
| 3,094,272 | 6/1963 | McClure . | |
| 3,116,872 | 1/1964 | Buechel et al. | 417/250 |
| 4,077,748 | 3/1978 | Pötz | 417/251 |
| 4,229,142 | 10/1980 | Le Dall et al. | 417/350 |
| 4,232,521 | 11/1980 | Mallofre | 60/612 |

FOREIGN PATENT DOCUMENTS

| | | | |
|---|---|---|---|
| 315646 | 6/1974 | Austria . | |
| 712796 | 10/1941 | Fed. Rep. of Germany | 417/250 |
| 806219 | 12/1958 | United Kingdom . | |

*Primary Examiner*—Cornelius J. Husar
*Assistant Examiner*—Peter M. Cuomo
*Attorney, Agent, or Firm*—Wenderoth, Lind & Ponack

[57] ABSTRACT

An air pump device comprises an electric motor, a low and a high pressure type pump disposed at both ends of a rotary shaft extending from the motor to be connected in series to each other through a discharge tube from the low pressure type pump extending to a suction port of the high pressure type pump, and an air suction tube connected via a valve to the discharge tube downstream of a change-over switch disposed in the discharge tube.

1 Claim, 1 Drawing Figure

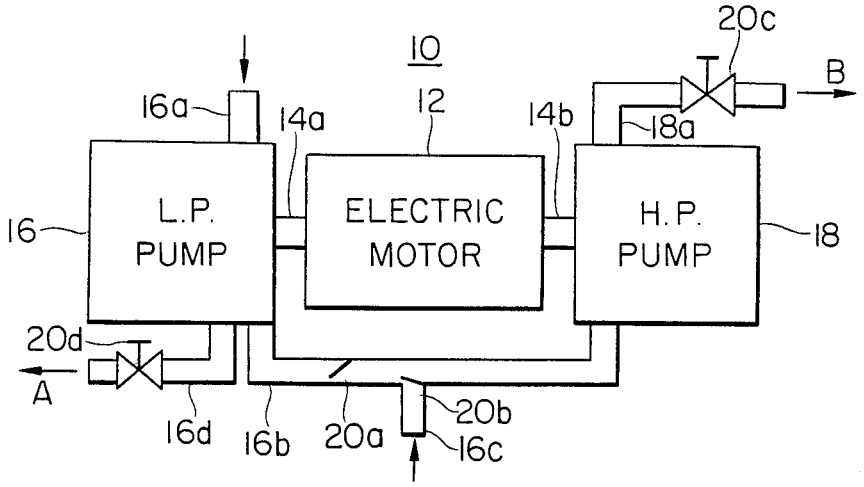
10
12
16a
14a
14b
20c
B
18a
16
L.P.
PUMP
ELECTRIC
MOTOR
H.P.
PUMP
18
20d
A
16d
16b
20a
20b
16c

PUMP DEVICE

This application is a continuation, of now abandoned application Ser. No. 548,134, filed Nov. 2, 1983 now abandoned.

BACKGROUND OF THE INVENTION

This invention relates to a pump device and more particularly to improvements in an air pump device.

A conventional air pump device has comprised an air pump or a compression motor including an electric motor and a pump mounted to an end of a rotary shaft extending beyond a housing for the electric motor and a suction and a discharge port operatively coupled to the pump.

When the electric motor is energized by an associated electric power source, a rotational force from the electric motor is supplied to the pump through the now driven pump to rotate vanes thereof to drawn air into the pump or compress the drawn in air. Then the compressed air is delivered to a utilization device through the discharge port.

In conventional air pump devices such as described above, the rotary shaft has extended only from one end of the electric motor to permit a single pump to be disposed on the rotary shaft. This has resulted in the disadvantage that it is difficult to provide an air pump device having a high compression ratio.

Accordingly it is an object of the present invention to provide a new and improved pump device having a high compression ratio with a simple construction.

SUMMARY OF THE INVENTION

The present invention provides a pump device comprising an electric motor, a rotary shaft extending from both ends of a housing for the electric motor, and a pair of pumps disposed at both extending ends of the rotary shaft to be connected in series to each other thereby to form a two stage compression structure.

In a preferred embodiment of the present invention one of the pumps is of a low pressure type and the other of the pumps is of a high pressure type. A discharge tube from the low pressure type pump is connected to a suction port of the high pressure type pump. An air suction tube is connected to an intermediate portion of the discharge tube through a valve. A change-over valve is disposed in the discharge tube upstream of the connection the air suction tube to the discharge tube.

BRIEF DESCRIPTION OF THE DRAWING

The present invention will become more readily apparent from the following detailed description taken in conjunction with the accompanying drawing in which a single FIGURE is a schematic elevational view of one embodiment according to the pump device of the present invention.

DESCRIPTION OF THE PREFERRED EMBODIMENT

Referring now to the drawing, there is illustrated one embodiment according to the air pump device of the present invention. The arrangement illustrated is an air pump device generally designated by the reference numeral 10, and comprises an electric motor 12, for example, a DC motor energized by a battery (not shown). The electric motor includes an integral rotary shaft having both end portions 14*a* and 14*b* extending from a housing (not shown) for the electric motor.

The arrangement further comprises a low pressure pump 16 disposed on the extremity of the extending shaft portion 14*a* and a high pressure pump 18 disposed on the extremity of the extending shaft portion 14*b*, a suction tube 16*a* operatively coupled to the low pressure pump 16, and a discharge tube 16*b* operatively coupled to the low pressure pump 16 and connected to a suction port of the high pressure pump 18 through a change-over valve 20*a*. The discharge tube 16*b* is also connected to an air suction tube 16*c* downstream of the change-over valve 20*a* through a change-over valve 20*b*. The change-over valves 20*a* and 20*b* are operative to change one of the tubes 16*b* and 16*c* for the other thereof.

A discharge tube 18*a* is operatively coupled to the high pressure pump 18 to deliver air compressed under a high or a low pressure as the case may be to a utilization device (not shown) through a control valve 20*c*.

Another discharge tube 16*d* is also operatively coupled to the low pressure pump 16 to deliver air compressed under a low pressure to a utilization device (not shown) through a control valve 20*d*.

The operation of the arrangement illustrated will now be described. When electric motor 12 is rotated, the low and high pressure pumps 16 and 18 respectively are simultaneously driven to rotate respective vanes (not shown) to compress air.

Assuming that the air compressed under the low pressure is required, the control valve 20*d* is opened and the change-over valve 20*a* is closed. Thus, air is drawn into the low pressure pump 10 through the suction tube 16*a* to be compressed under the low pressure and then delivered in the direction of the arrow A shown in the drawing through the discharge tube 16*d* and the now open control valve 20*d*. At that time the change-over valve 20*b* interlocks with the closure of the change-over valve 20*a* to be opened. This opening of the valve 20*b* permits air under the atmospheric pressure to enter the high pressure pump 18. Thus air is compressed under a low pressure in the high pressure pump 18 and then delivered in the direction of the arrow B shown through the discharge tube 18*a* and the control valve 20*c* now put in its open position.

Assuming now that air compressed under a high pressure is required, the valves 20*d* and 20*b* are closed while the valves 20*a* and 20*c* are opened. Under these circumstances air is drawn via the suction tube 16*a* into the low pressure pump 16 where it is compressed once after which the compressed air is drawn into the high pressure pump 18 through the discharge tube 16*b* and the now open change-over valve 20*a*. In the high pressure pump 18 the compressed air is further compressed under a high pressure. The air thus compressed is delivered in the direction of the arrow B through the discharge tube 18*a* and the control valve 20*c* now put in its open position. The delivered air forms an operating fluid which is, in turn, used as a source of compressed air for an air cylinder or, air motor or the like.

From the foregoing it is seen that, according to the present invention, high pressure air can readily be provided because a single electric motor is used to compress air at two stages. Also since the electric motor is loaded at both ends of the rotary shaft thereof, the loading on the motor is maintained well balanced.

While the present invention has been illustrated and described in conjunction with a single preferred embodiment thereof it is to be understood that numerous changes and modifications may be resorted without departing from the spirit and scope of the present invention. For example, while the present invention has been described in terms of air, it is not restricted thereto or thereby and it is equally applicable to any fluid other than air, for example, water. Also while the present invention has been described in conjunction with the use as either a low pressure pump or a high pressure pump, it is to be understood that the present invention is applicable to an exclusively high pressure pump. In the latter case, the discharge tube 16*d* and the air suction tube 16*c* are omitted, along with the associated valves.

What is claimed is:

1. A pump device, comprising:

an electric motor having an integral rotary shaft for providing a mechanical output thereof, said shaft having first and second opposite ends, extending from opposite sides of said motor;

a low pressure pump having a first fluid input and a first fluid output, directly connected to said first end of said shaft so as to be driven by rotation of said shaft;

a high pressure pump having a second fluid input and a second fluid output, directly connected to said second end of said shaft so as to be driven by rotation of said shaft;

a first discharge conduit connecting said first fluid output to said second fluid input for directing fluid from said low pressure pump to said high pressure pump;

a first change-over valve in said first discharge conduit for selectively blocking fluid communication between said first fluid output and said second fluid input through said first discharge conduit;

a fluid suction conduit having a third fluid input at one end, connected at its other end to said first discharge conduit downstream of said first change-over valve and upstream of said second fluid input, for providing fluid communication therewith;

means, including a second change-over valve in said fluid suction conduit, for selectively blocking fluid communication between said third fluid input and said first discharge conduit;

a second discharge conduit connected to said second fluid output, for directing the outflow of all high or low pressure fluid from said second fluid output of said high pressure pump;

means, including a first control valve in said second discharge conduit, for selectively blocking all of the outflow of fluid from said high press pump;

a third discharge conduit directly connected to said first fluid output upstream of said first change-over valve, for discharging low pressure fluid from said low pressure pump for low pressure use; and a second control valve in said third discharge conduit, for selectively blocking the outflow of fluid from said low pressure pump through said third discharge conduit.

* * * * *